US011351473B2

(12) United States Patent
Lee

(10) Patent No.: US 11,351,473 B2
(45) Date of Patent: Jun. 7, 2022

(54) TOY BUILDING ELEMENT AND TOY BUILDING SET

(71) Applicant: TransformCube Product Design Limited, Kowloon (HK)

(72) Inventor: Kai Pang Lee, Tuen Mun (HK)

(73) Assignee: TransformCube Product Design Limited, Hong Kong (CN)

( * ) Notice: Subject to any disclaimer, the term of this patent is extended or adjusted under 35 U.S.C. 154(b) by 0 days.

(21) Appl. No.: 16/200,674

(22) Filed: Nov. 27, 2018

(65) Prior Publication Data

US 2019/0168129 A1 Jun. 6, 2019

Related U.S. Application Data

(60) Provisional application No. 62/595,135, filed on Dec. 6, 2017.

(51) Int. Cl.
*A63H 33/06* (2006.01)
*A63H 33/08* (2006.01)

(52) U.S. Cl.
CPC ..... *A63H 33/067* (2013.01); *A63H 33/08* (2013.01); *A63H 33/088* (2013.01)

(58) Field of Classification Search
CPC .... A63H 33/042; A63H 33/067; A63H 33/08; A63H 33/088; A63H 33/106
USPC ..... 446/102, 103, 104, 120, 124
See application file for complete search history.

(56) References Cited

U.S. PATENT DOCUMENTS 3,234,683 A * 2/1966 Godtfred ..... A63H 17/262 446/103
3,648,404 A * 3/1972 Ogsbury ..... A63H 33/102 446/126
3,747,261 A * 7/1973 Salem ..... A63H 33/108 446/104
3,965,610 A * 6/1976 Den Ouden ..... A63H 33/042 446/103
4,740,189 A * 4/1988 Bertrand ..... A63H 33/086 446/102
5,172,534 A * 12/1992 Milner ..... A63H 33/042 446/104
5,769,681 A * 6/1998 Greenwood, Sr. ... A63H 33/062 446/120

(Continued)

*Primary Examiner* — Joseph B Baldori
(74) *Attorney, Agent, or Firm* — Bayes PLLC

(57) ABSTRACT

The present disclosure provides an integrated design building block with turnable modules inside, the building block comprising: a lower housing, an upper housing, and a plurality of turnable modules mechanism, the lower housing and the upper housing being fitted to form a plurality of receiving spaces, the plurality of turnable modules being disposed within the plurality of receiving spaces, respectively, wherein the turnable modules may be partially or completely received in the receiving spaces, the turnable modules each having a turnable module connection portion; the lower housing and the upper housing are fitted to form a body structure of the building block; a plurality of connection portions are provided on surfaces of the body structure; the turnable module connection portions are fitted to the plurality of connection portions on the surfaces of the body structure. The building block provided by the present disclosure has advantages of a simple mechanical structure and a low cost. The present disclosure further provides a building set.

11 Claims, 8 Drawing Sheets

(56) References Cited

U.S. PATENT DOCUMENTS

| | | | | |
|---|---|---|---|---|
| 5,803,782 | A * | 9/1998 | Selton | A47B 47/0016 446/125 |
| 6,030,270 | A * | 2/2000 | Krog | A63H 33/042 446/102 |
| 6,176,757 | B1 * | 1/2001 | Lin | A63H 33/101 446/102 |
| 6,595,825 | B1 * | 7/2003 | De Wilde | A63H 33/067 446/102 |
| 6,773,323 | B1 * | 8/2004 | Huang | A63H 31/00 446/103 |
| 7,588,476 | B2 * | 9/2009 | Hammond | A63H 33/086 446/104 |
| 8,888,552 | B2 * | 11/2014 | Wizenberg | A63H 33/086 446/102 |
| 2015/0251104 | A1 * | 9/2015 | Lange | A63H 33/042 446/92 |
| 2016/0123360 | A1 * | 5/2016 | Lin | F16B 7/04 403/122 |
| 2018/0353871 | A1 * | 12/2018 | Oschuetz | B25J 19/0029 |

* cited by examiner

TOY BUILDING ELEMENT AND TOY BUILDING SET

CROSS REFERENCE TO RELATED APPLICATION

This non-provisional patent application claims priority under 35 U.S.C. § 119(e) to U.S. Provisional Patent application, Ser. No. 62/595,135, filed Dec. 6, 2017, the disclosures of which are incorporated by reference in entirety.

FIELD

The present disclosure relates to the field of building blocks, and more particularly relates to a building block and a building set assembled by building blocks.

BACKGROUND

A traditional building block has a plug on a surface, and assembly is carried out by inserting the plug on the surface into a plug-hole or slot of another building block. A Lego toy is an example thereof. However, such plugs have the following problems: they cannot be assembled into a large plane; they have projections that would block movable parts.

Traditional building blocks are extruded by injection molding. Consequently, these plugs are fixed to the surface of the building blocks, the surfaces of the finally built structure will have projections, and consequently a planar structure cannot be formed.

Therefore, it is quite necessary to provide a building block with a simple structure, a low cost, and a planar outer surface.

SUMMARY

A main objective of the present disclosure is to provide an integrated design building block with a simple mechanical structure, a low cost, and a planar outer surface.

The present disclosure provides a building block with turnable modules inside, the building block comprising: a lower housing, an upper housing, and a plurality of turnable modules mechanism, the lower housing and the upper housing being fitted to form a plurality of receiving spaces, the plurality of turnable modules being disposed within the plurality of receiving spaces, respectively, wherein the turnable modules may be partially or completely received in the receiving spaces, the turnable modules each having a turnable module connection portion; the lower housing and the upper housing are fitted to form a body structure of the building block; a plurality of connection portions are provided on surfaces of the body structure; the turnable module connection portions are fitted to the plurality of connection portions on the surfaces of the body structure.

Preferably, the lower housing and the upper housing are fitted to form a first receiving portion and a second receiving portion; and two turnable modules are provided, the two turnable modules being disposed in the first receiving portion and the second receiving portion, respectively.

Preferably, the body structure generally has a cubic structure.

Preferably, the body structure has six receiving portions inside; and six turnable modules are provided, the six turnable modules being disposed in the six receiving portions, respectively.

Preferably, a bottom portion connection portion is formed on a bottom portion of the body part, a top portion connection portion is formed at a top portion of the body part, and a side surface connection portion is formed at a side surface of the body part, wherein the bottom portion connection portion, the top portion connection portion and the side surface connection portion are all fitted to the turnable module connection portions.

Preferably, two side surface connection portions are provided, the two side surface connection portions being disposed on two opposite surfaces of the body part, respectively.

Preferably, the turnable module further comprises a turnable module body, the turnable module body generally having a spherical-like structure and comprising a first surface, a second surface, and a side surface, wherein the first surface and the second surface are parallel to each other, and the side surface is connected to the first surface and the second surface.

Preferably, the turnable module further comprises a turnable module recessed portion, the turnable module recessed portion being formed by inwardly recession from a middle portion of the second surface, the turnable module connection portion being formed by outward extension from the first surface, and the turnable module connection portion being fitted to the turnable module recessed portion.

Preferably, the turnable module comprises a turnable module first limiting portion and a turnable module second limiting portion, the first limiting portion and the second limiting portion being fitted to limit the turnable module inside the receiving portion.

The present disclosure provides a building set, wherein the building set is formed by connecting a plurality of building blocks without projections on surfaces, the plurality of building blocks being the building blocks as described above.

Preferably, the building set has a cuboid structure.

Preferably, two turnable modules are provided, and extension directions of turnable module connection portions of adjacent two building blocks are perpendicular to each other.

The building block provided by the present disclosure has advantages such as a simple mechanical structure and a low cost. Besides, the outer surfaces of the building set assembled by building blocks may have a planar structure. In this way, the present disclosure may be applied to assemble various kinds of cuboid structures, e.g., furniture such as a sliding drawer, a desk/chair with a lifting mechanism; the present disclosure may alternatively be applied to assemble a model of a building, where it may not only facilitate the assembling work, but also may reduce the costs for research, development, and modeling; meanwhile, during the process of assembling the building blocks, it may trigger the creativity of people and sooth their pressures in work and life.

BRIEF DESCRIPTION OF THE DRAWINGS

To elucidate the technical solutions of the present disclosure, the drawings used in describing the embodiments will be briefly introduced below. It is apparent that the drawings as described only relate to some embodiments of the present disclosure. To those skilled in the art, other drawings may be derived based on these drawings without exercise of inventive work, wherein.

Figure 1:
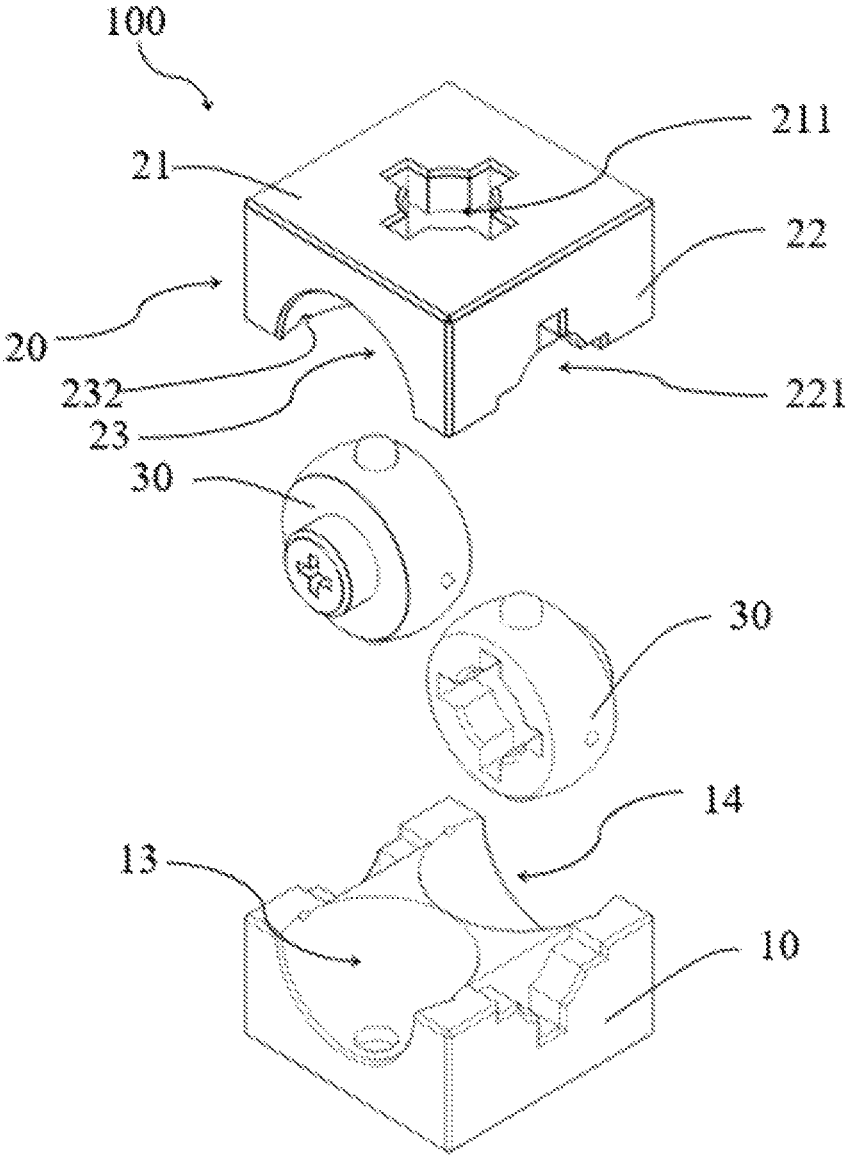
FIG. 1 shows an exploded structural schematic diagram of an integrated design building block provided by the present disclosure.

LIST OF REFERENCE NUMERALS integrated design building block 100; lower housing 10; lower housing bottom wall 11; bottom portion connection portion 111; lower housing sidewall 12; lower housing side surface connection portion 121; lower housing first receiving portion 13; bottom portion limiting portion 131; lower housing side limiting portion 132; lower housing second receiving portion 14; upper housing 20; upper housing top portion 21; top portion connection portion 211; upper housing sidewall 22; upper housing side surface connection portion 221; upper housing first receiving portion 23; turnable module 30; turnable module body 31; first surface 311; second surface 312; side surface 313; turnable module connection portion 32; turnable module first limiting portion 33; turnable module second limiting portion 34; turnable module recessed portion 35; side surface connection portion 40; building set 200.

DETAILED DESCRIPTION OF EMBODIMENTS

Hereinafter, the technical solution of the present disclosure will be described in a clear and comprehensive manner with reference to the accompanying drawings; it is apparent that the embodiments described here are part of the embodiments of the present disclosure, not all of them. All other embodiments obtained by those skilled in the art without exercise of inventive work based on the examples in the embodiments all fall within the protection scope of the present disclosure.

Figure 2A:
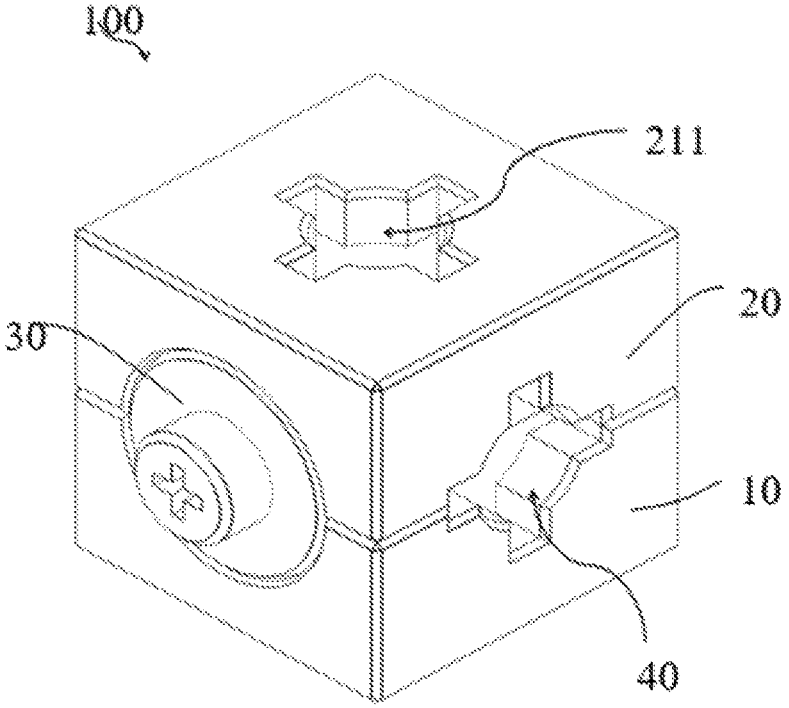
FIG. 2A shows a structural schematic diagram of an assembled state of the building block and the turnable module turned to plug side shown in FIG. 1.
Figure 2B:
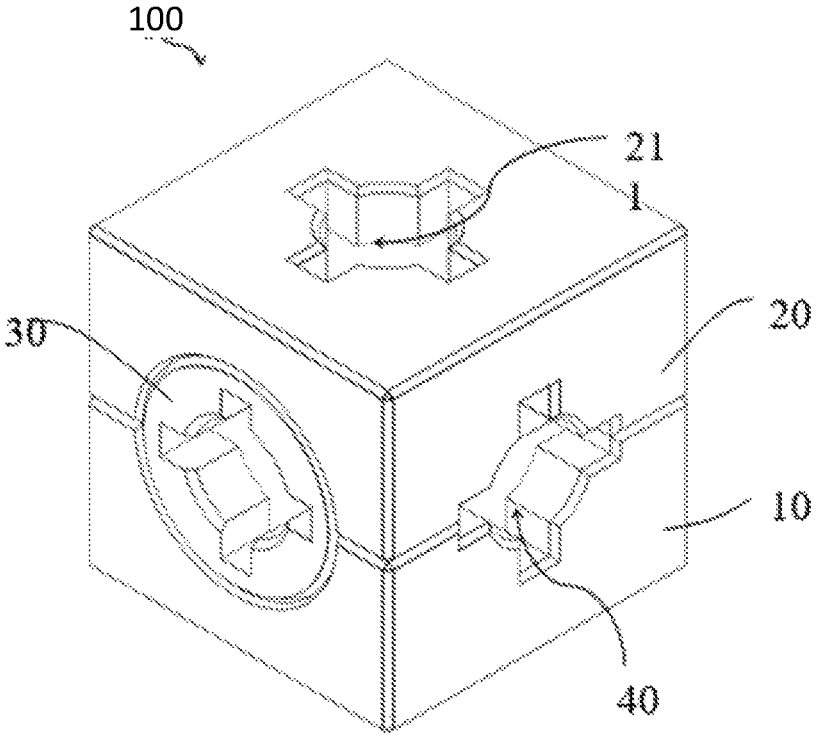
FIG. 2B shows a structural schematic diagram of another assembled state of the building block and the turnable module turned to hole side shown in FIG. 1.
Figure 2C:
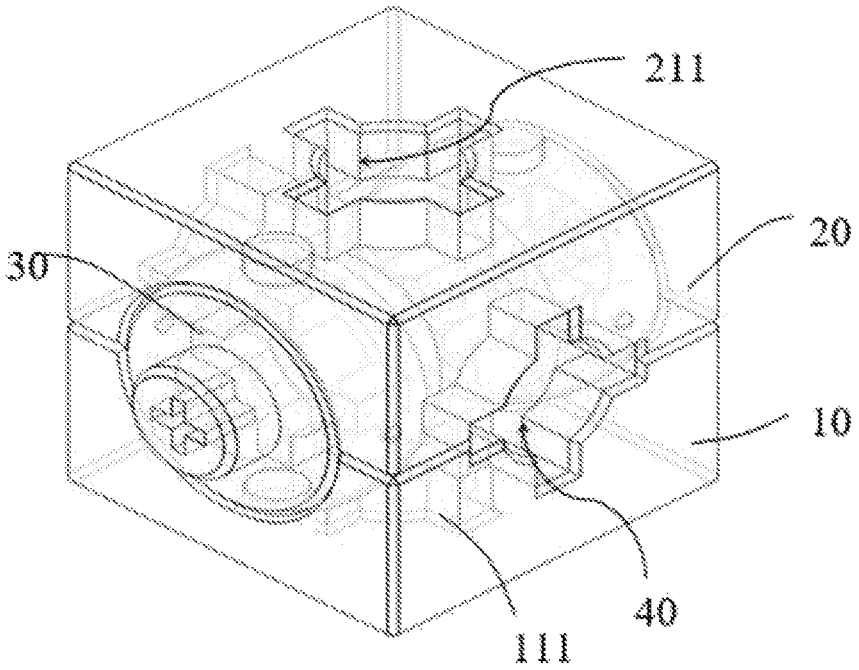
FIG. 2C shows a perspective structural schematic diagram and hidden detail of an assembled state of the building block shown in FIG. 1.

Please refer to FIGS. 1-2C, where FIG. 1 shows an exploded structural schematic diagram of a building block provided by the present disclosure; FIG. 2A shows a structural schematic diagram of an assembled state of the building block shown in FIG. 1; FIG. 2B shows a structural schematic diagram of another assembled state of the building block shown in FIG. 1; and FIG. 2C shows a perspective structural schematic diagram of an assembled state of the building block shown in FIG. 1.

The integrated design building block 100 comprises a lower housing 10, an upper housing 20, and a turnable module 30. The upper housing 10 and the lower housing 20 are fitted to form a receiving space. The turnable module 30 may be partially or completely received in the receiving space.

Figure 3:
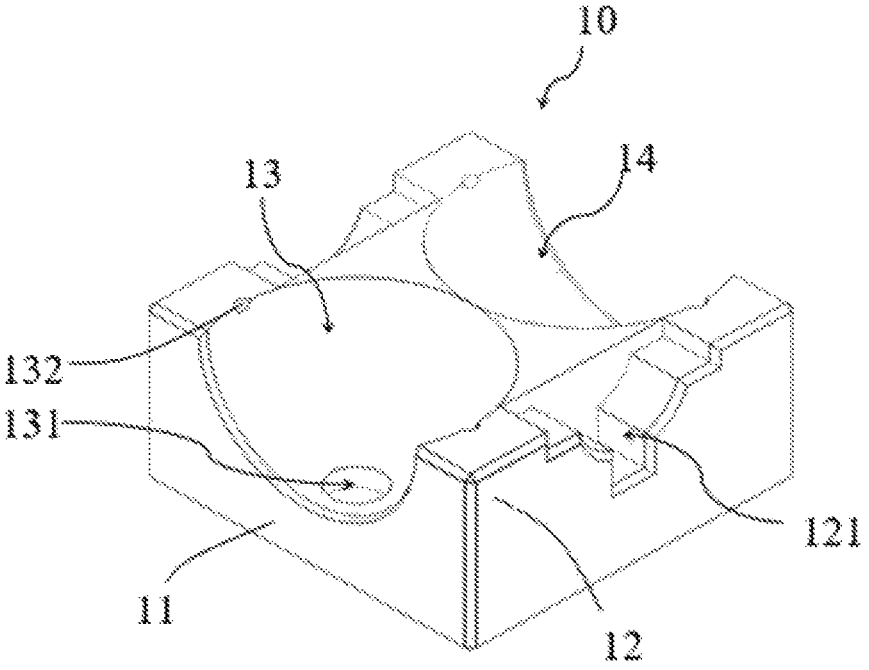
FIG. 3 shows a structural schematic diagram of a lower housing of the building block shown in FIG. 1.
Figure 4A:
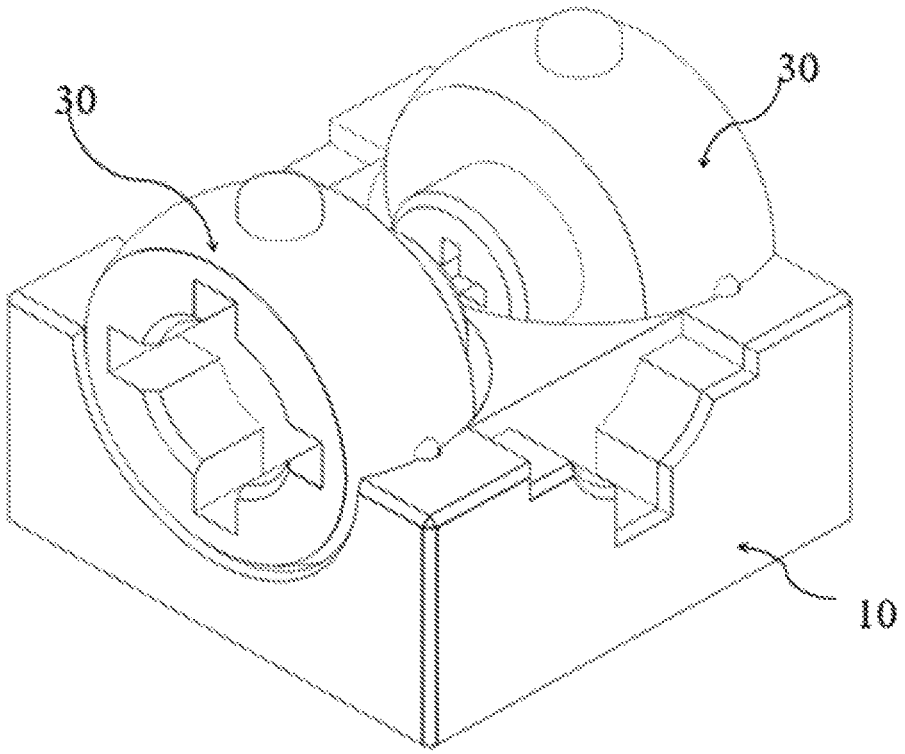
FIG. 4A shows a schematic diagram of an assembled state of a lower housing and two turnable modules of the building block shown in FIG. 1.
Figure 4B:
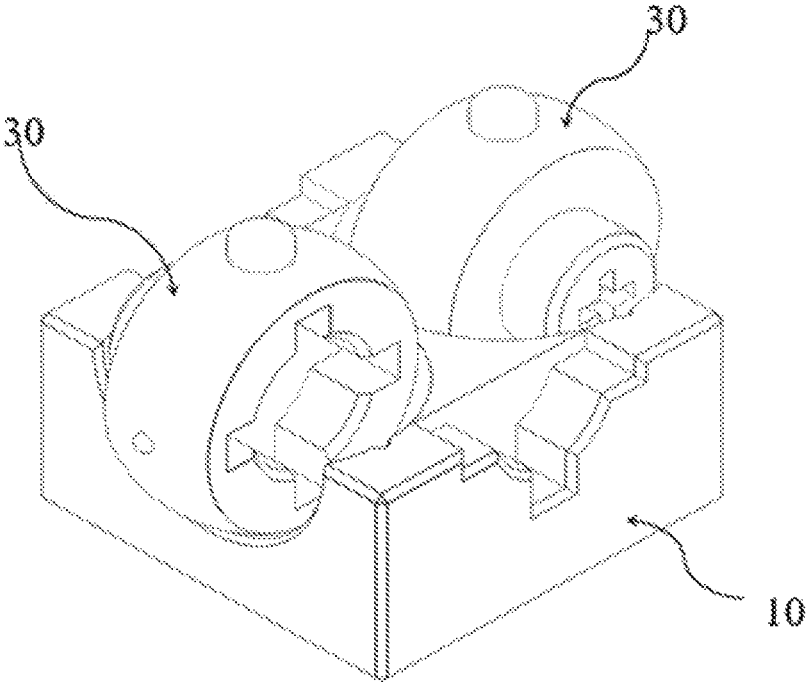
FIG. 4B shows a schematic diagram of another assembled state of the lower housing and the turnable modules turned to other direction of the building block shown in FIG. 1.

Please refer to FIG. 3~FIG. 4B, where the lower housing 10 comprises a lower housing bottom wall 11, a lower housing sidewall 12, a lower housing first receiving portion 13, and a lower housing second receiving portion 14. The lower housing bottom wall 11 is connected to the lower housing sidewall 12. The lower housing first receiving portion 13 and the lower housing second receiving portion 14 are adjacently arranged.

The lower housing bottom wall 11 is disposed at a bottom portion of the lower housing 10. A central position of a bottom surface of the lower housing bottom wall 11 comprises a bottom portion connection portion 111.

The bottom portion connection portion 111 is disposed at a bottom surface of the lower housing 10; further, the lower housing 10 is disposed at a central position of the bottom surface of the lower housing 10.

The bottom portion connection portion 111 is configured for connecting with the turnable module 30 of another building block 100. A specific structure of the bottom portion connection portion 111 may be arranged to fit the structure of the turnable module 30, which is not limited herein. In this embodiment, the bottom portion connection portion 111 is formed by inward recession from the bottom surface of the lower housing 10 to form a recessed structure, and the recessed structure generally has a cross-like structure; it may be understood that the recessed structure is fitted to the structure of the turnable module connection portion 32. The recessed structure of the bottom portion connection portion 111 disclosed in the present disclosure is only an example. The structure of the bottom portion connection portion 111 may alternatively be adapted based on actual needs, which is not limited herein.

The lower housing sidewall 12 is connected to the lower housing bottom wall 11. Further, the lower housing sidewall 12 is vertically connected to the lower housing bottom wall 11. The lower housing first receiving portion 13 and the lower housing second receiving portion 14 are formed inside the lower housing sidewall 12 and the lower housing bottom wall 11. In this embodiment, two lower housing sidewalls are provided, wherein the two lower housing sidewalls 12 are oppositely arranged. A lower housing side surface connection portion 121 is provided at a middle portion of the outer side surface of each of the two lower housing sidewalls 12. In this embodiment, a shape of the lower housing side surface connection portion 121 is just a half of the bottom portion connection portion 111. It may be understood that in other embodiments, a shape of the lower housing side surface connection portion 121 may be specifically configured based on actual needs, which is not limited herein.

The lower housing first receiving portion 13 is configured for receiving part of the turnable module 30. In this embodiment, a shape of the lower housing first receiving portion 13 is fitted to the structure of the turnable module 30. The first receiving portion 13 comprises a bottom portion limiting portion 131 and a lower housing side surface limiting portion 132.

The bottom portion limiting portion 131 is arranged at a bottom portion of the lower housing first receiving portion 13. The bottom portion limiting portion 131 may be a through hole, i.e., the bottom portion limiting portion 131 may be through the lower housing bottom wall 11; the bottom portion limiting portion 131 may alternatively be a non-through hole, i.e., the bottom portion limiting portion 131 is formed by inward recession from the lower housing first receiving portion 13, and the bottom portion connection portion 111 is not through the bottom wall of the lower housing 10. In this embodiment, the bottom portion limiting portion 131 is a non-through hole.

The lower housing side surface limiting portion 132 is arranged at a top portion of the lower housing first receiving portion 13. In this embodiment, two lower housing side surface limiting portions 132 are provided, wherein the two lower housing side surface limiting portions 132 are arranged at two opposite side surfaces of the lower housing first receiving portion 13. In this embodiment, the lower housing side surface limiting portion 132 may be a half hole or a full hole, a diameter of the lower housing side surface limiting portion 132 is smaller than that of the bottom portion limiting portion 131, and the lower housing side surface limiting portion 132 is a non-through hole; of course, in other embodiments, the diameter of the lower housing side surface limiting portion 132 may alternatively be equal to or larger than the diameter of the bottom portion limiting portion 131, and the lower housing side surface limiting portion 132 may alternatively be a through hole; the present disclosure has no limitation in this aspect.

In this embodiment, a structure of the lower housing second receiving portion 14 is completely identical to the structure of the lower housing first receiving portion 13, which will not be detailed here. The lower housing second receiving portion 14 and the lower housing first receiving portion 13 are symmetrically arranged. It may be understood that in other embodiments, the lower housing second receiving portion 14 and the lower housing first receiving portion 13 may alternatively be configured according to actual needs, and they may be configured not completely identical; the present disclosure has no limitation in this aspect.

The upper housing 20 and the lower housing 10 are fitted to form a receiving space that may accommodate a plurality of turnable modules 30. In this embodiment, the upper housing 20 and the lower housing 10 may be connected by snap fixation, adhesive fixation, and bolt fixation, which is not limited herein.

In this embodiment, the upper housing 20 has a same structure as the lower housing 10; the upper housing 20 and the lower housing 10 are fitted to form a cuboid structure. Preferably, the upper housing 20 and the lower housing 10 are fitted to form a cubic structure. It may be understood that in other embodiments, the upper housing 20 may have other shapes, e.g., a semi-cylindrical structure, a semi-spherical structure, etc., which is not limited herein. The specific shape may be changed according to actual needs, which is not limited herein. The upper housing 20 likewise comprises an upper housing top portion 21, an upper housing sidewall 22, an upper housing first receiving portion 23, and an upper housing second receiving portion (not shown).

The upper housing top portion 21 has the same structure as the lower housing bottom wall 11, which is not limited herein. The upper housing top portion 21 comprises a top portion connection portion 211.

The top portion connection portion 211 is likewise connected to the turnable module 30 of another building block 100. The top portion connection portion 211 is disposed at a central position of a top surface of the lower housing 10. The top portion connection portion 211 has the same structure as the bottom portion connection portion 111, which thus will not be detailed here.

The upper housing sidewall 22 is likewise connected to the upper housing bottom wall 21. Two upper housing sidewalls 22 are provided, wherein the two upper housing sidewalls 22 are oppositely arranged and are both vertically connected with the upper housing bottom wall 21. The upper housing first receiving portion 23 and the upper housing second receiving portion are formed inside the upper housing sidewall 22 and the upper housing bottom wall 21. Similar to the structure of the lower housing sidewall 12, a middle portion of the outer side wall of the upper housing sidewall 22 comprises an upper housing side surface connection portion 221. Likewise, the upper housing side surface connection portion 221 is just half of the top portion connection portion 211. It may be understood that in other embodiments, a shape of the upper housing side surface connection portion 221 may be specifically configured based on actual needs, which is not limited herein. In this embodiment, a structure of the upper housing sidewall 22 is completely identical to the structure of the lower housing side wall 12, which is thus not be detailed here.

When the upper housing 20 and the lower housing 10 are in an assembled state, the two upper housing side surface connection portions 221 are combined with the two lower housing side surface connection portions 121 to form a side surface connection portion 40. The portion 40 may form in whole by extended upper housing 20 or lower housing 10 in manufacturing needs. It may be understood that two side surface connection portions 40 are provided, wherein the two side surface connection portions 40 are oppositely arranged and have a same structure; further, the structure of the side surface connection portions 40 is identical to that of the top portion connection portion 211 and the bottom portion connection portion 111, which is thus not detailed here.

The upper housing first receiving portion 23 is configured for receiving part of the turnable module 30; moreover, a shape of the upper housing first receiving portion 23 is fitted to the structure of the turnable module 30. The upper housing first receiving portion 23 comprises a top portion limiting portion (not shown) and an upper housing side surface limiting portion 232. In this embodiment, the structure of the upper housing first receiving portion 23 is identical to that of the lower housing first receiving portion 13; besides, the structures of the top portion limiting portion and the upper housing side surface limiting portion 232 are identical to those of the bottom portion limiting portion 131 and the lower housing side surface limiting portion 132, respectively, which are thus not detailed here.

When the upper housing 20 and the lower housing 10 are in a connected state, the upper housing first receiving portion 23 and the lower housing first receiving portion 13 are fitted to form a first receiving portion, the first receiving portion being for receiving and limiting the turnable module 30; the top portion limiting portion and the bottom portion limiting portion 131 are oppositely arranged; and the upper housing side surface limiting portion 232 and the lower housing side surface limiting portion 132 are fitted to form a side surface limiting portion; it may be understood that the upper housing side surface limiting portion 232 and the lower housing side surface limiting portion are both provided in two; the two housing side surface limiting portions 232 and the two lower housing side surface limiting portions 132 are fit in one-to-one correspondence to form two side surface limiting portions. In this embodiment, the side surface limiting portion is a hole structure; namely, the upper housing side surface limiting portion 232 and the lower housing side surface limiting portion 132 are both of a semi-hole structure, such that a side surface limiting portion formed by fitting of both is a full-hole structure; in other embodiments, the upper housing side surface limiting portion 232 and the lower housing side surface limiting portion 132 may alternatively assume other shapes, which is not limited herein.

The upper housing second receiving portion and the upper housing first receiving portion 23 have the same structure; moreover, the upper housing second receiving portion and the upper housing first receiving portion 23 are symmetrically arranged, which are not detailed here. When the upper housing 20 and the lower housing 10 are in a connected state, the upper housing second receiving portion and the upper housing first receiving portion 23 are fitted to form a second receiving portion. The second receiving portion is configured for receiving the turnable module 30.

Figure 5A:
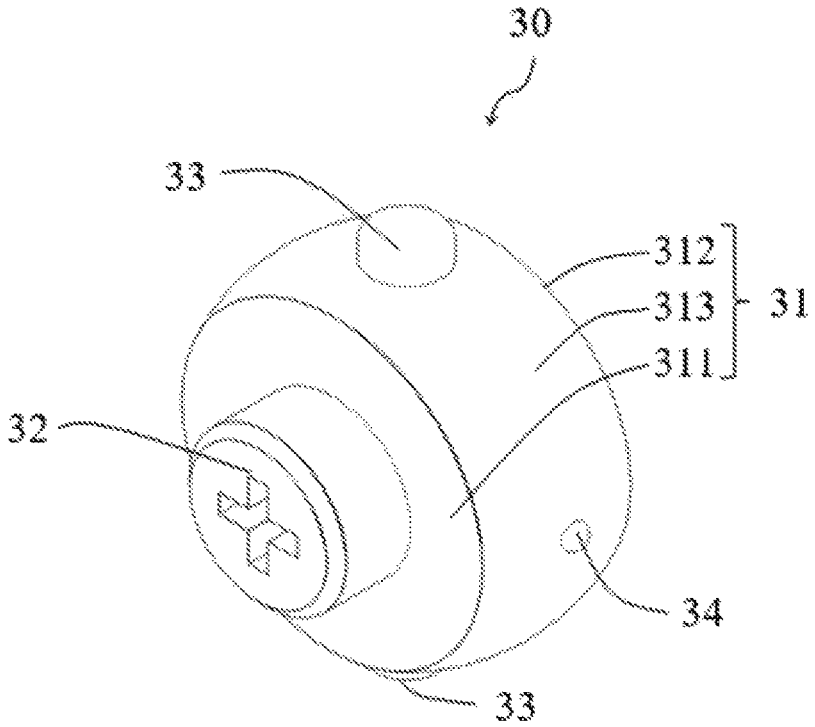
FIG. 5A shows a structural schematic diagram from one angle of the turnable module of the building block shown in FIG. 1.
Figure 5B:
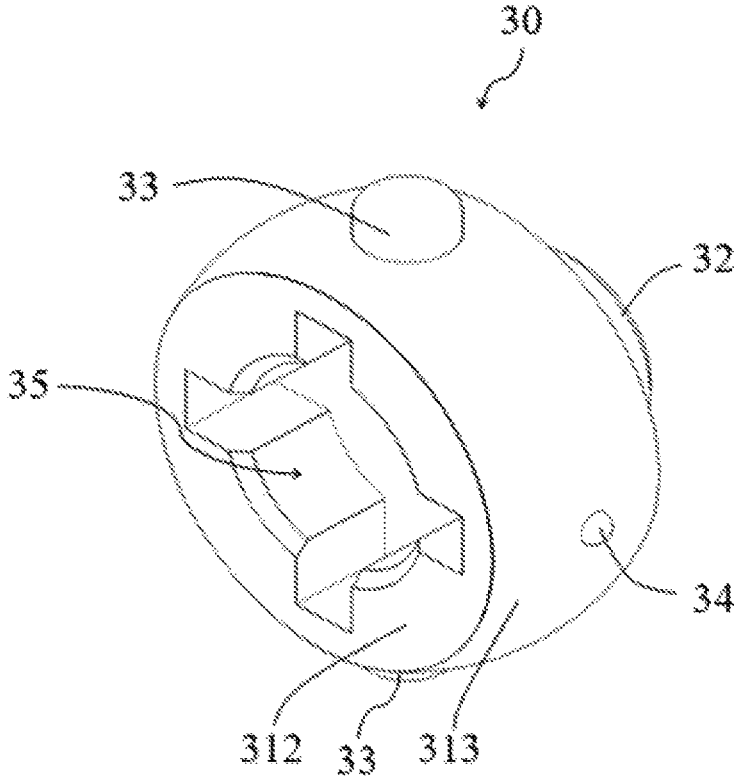
FIG. 5B shows a structural schematic diagram from the other angle of the turnable module of the building block shown in FIG. 1.
Figure 5C:
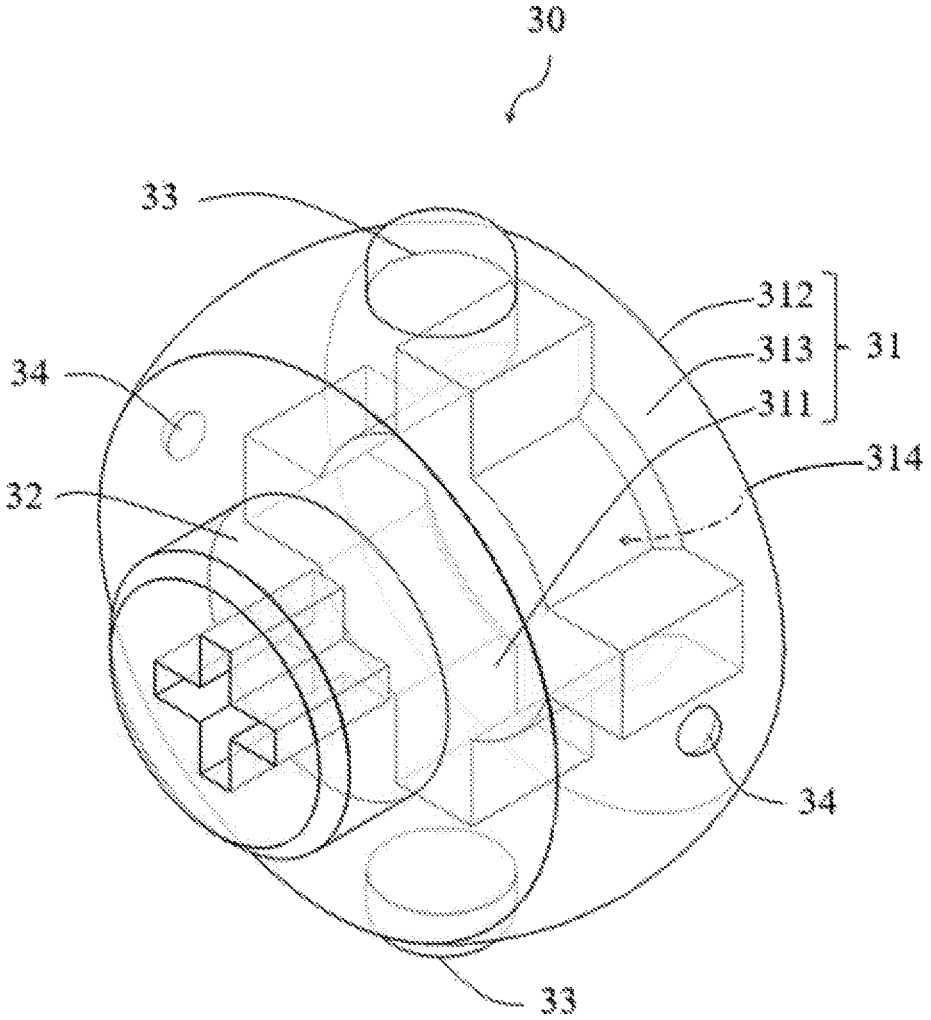
FIG. 5C shows a perspective structural schematic diagram and hidden detail of the turnable module of the building block shown in FIG. 1.

Please refer to FIGS. 5A-5C, the turnable module 30 is disposed inside the body structure formed by fitting the lower housing 10 and the upper housing 20; further, the turnable module 30 is disposed within the receiving space formed when the lower housing 10 and the upper housing 20 are in an assembled state. In this embodiment, two turnable modules 30 are provided, the two turnable modules 30 being disposed in the first receiving portion and the second receiving portion, respectively. It may be understood that in other embodiments, the turnable module 30 may be provided in other numbers; a plurality of the turnable modules are completely or partially received within the receiving space fitted by the lower housing 10 and the upper housing 20, respectively.

The turnable module 30 comprises a turnable module body 31, a turnable module connection portion 32, a turnable module first limiting portion 33, and a turnable module second limiting portion 34.

The turnable module body 31 generally has a spherical-like structure. Specifically, a cross-section of the turnable module body 31 is of a circular shape, and a diameter of the circular cross-section in a middle portion of the turnable module body 31 is larger than that of the circular cross-section at an edge of the turnable module body 31. The turnable module body 31 comprises a first surface 311, a second surface 312, a side surface 313, and a through-hole 314 through the turnable body 31. Further, the turnable module body 31 is a partial structure of a sphere. Namely, the center of the turnable module body 31 is a circular center; the first surface 311 and the second surface 312 are mutually parallel and their distances from the center of the turnable module body 31 are identical; it may be understood that at this point, the side surface 313 is a spherical surface; the distances from any points on the side surface 313 to the center of the turnable module body 31 are identical.

The first surface 311 and the second surface 312 are parallel to each other; further, the first surface 311 has a same area as the second surface 312. In other embodiments, the areas of the first surface 311 and the second surface 312 may be adapted to actual needs; their areas may be different, which is not limited herein.

The side surface 313 connects the first surface 311 and the second surface 312; the side surface 313 is higher in the middle, but lower in the edge, and transits smoothly from the middle portion of the side surface 313 to the edge. Preferably, the side surface 313 is arranged as a spherical face.

The through-hole 314 is through the turnable module body 31, and an extending direction of the through-hole 314 is vertical to the first surface 311 and the second surface 312; further, the through-hole 314 is through a central position of the first surface 311 and that of the second surface 312, respectively.

The turnable module connection portion 32 is partially received in the through-hole 314 and partially extends out of the first surface 311. It may be understood that the turnable module connection portion 32 and the turnable module body 31 may have an integral structure; in this case, the turnable module body 31 does not include the through-hole 314. In this embodiment, the turnable module connection portion 32 is a stud. A bottom end of the stud is fixedly screwed to the through-hole 314, and a top end of the stud extends out of the first surface 311. Further, a length of the stud extending out of the first surface 311 is smaller than or equal to the depth of the through-hole 314 not screwed to the stud. The turnable module connection portion 32 is fitted to the bottom portion connection portion 111, the top portion connection portion 211, and the two side surface connection portions 40; and the length and diameter of the turnable module connection portion 32 are fitted to the bottom portion connection portion 111, the top portion connection portion 211, and the two side surface connection portion 40. In other words, the turnable module connection portion 32 may be just snap-embedded in the bottom portion connection portion 111, the top portion connection portion 211, or the two side surface connection portions 40 of another building block 100 of a same dimension.

It may be understood that the turnable module connection portion 32 may alternatively be formed by outward extending from the first surface 311, wherein an extending direction of the turnable module connection portion 32 is arranged vertical to the first surface.

The turnable module recessed portion 35 is formed by inward recession from the middle portion of the second surface, wherein a recession direction of the turnable module recessed portion 35 is arranged vertical to the second surface. The turnable module recessed portion 35 is fitted to the turnable module connection portion 32, i.e., the turnable module connection portion 32 may be received and limited inside the turnable module recessed portion 35. Further, the structure of the turnable module recessed portion 35 is identical to the bottom portion connection portion 111, the top portion connection portion 211, and the two side surface connection portions 40.

The turnable module first limiting portion 33 is a projected structure; the turnable module first limiting portion 33 is disposed in a middle portion of the side surface 313, wherein an extending direction of the projected structure of the turnable module first limiting portion 33 is vertical to the extending direction of the turnable module connection portion 32. In this embodiment, two turnable module first limiting portions 33 are provided, the two turnable module first limiting portions 33 being disposed at two opposite ends of the side surface 313, and their extending directions are on the same straight line.

When the building block 100 is in an assembled state and the turnable module 30 is disposed in the first receiving portion, the two turnable module first limiting portions 33 are connected to the bottom portion limiting portion 131 and the top portion limiting portion, and the lengths and diameters of the two turnable module first limiting portions 33 are fitted to the depths and diameters of the bottom portion limiting portion 131 and the top portion limiting portion, respectively, such that the turnable module 30 may rotate about the two turnable module first limiting portions 33.

The turnable module second limiting portion 34 also has a projected structure, and is also disposed in the middle portion of the side surface 313, like the turnable moule second limiting portion 34. In this embodiment, two turnable module second limiting portions 34 are provided, the two turnable module second limiting portions 34 being disposed at two opposite ends of the side surface 313, and their extending directions are on the same straight line. Preferably, an extending direction of the two turnable module second limiting portions 34 are arranged vertical to the extending direction of the two turnable module first limiting portions 33, and the extending direction of the two turnable module second limiting portions 34 is perpendicular to the extending direction of the turnable module connection portion 32. It may be understood that in other embodiments, the turnable module second limiting portion 34 may be provided in one or other number, which is not limited herein.

When the building block 100 is in an assembled state and the turnable module 30 is disposed in the first receiving portion, the two turnable module second limiting portions 34 are connected to the two side surface limiting portions, and the lengths and diameters of the two turnable module second limiting portions 34 are fitted to the depths and diameters of the two side surface limiting portions, respectively, thereby preventing the turnable module 30 from rotating about the two turnable module first limiting portions 33. Namely, the turnable module second limiting portion 34 and the turnable module first limiting portion 33 are fitted to limit the turnable module 30. Or, the turnable module first limiting portion 33 and the second limiting portion 34 are fitted to limit the turnable module 30 in the first receiving portion.

It may be understood that when the building block 100 is in an assembled state, the turnable module 30 may opt to be fixed in such a manner that the first surface 311 is away from the direction of the first receiving portion, or opt to be fixed in such a manner that the first surface 311 is towards the direction of the second receiving portion. When the turnable module is fixed in the manner that the first surface 311 is away from the direction of the first receiving portion, the turnable module connection portion 32 is disposed outside the first receiving portion; when the turnable module is fixed in the manner that the first surface 311 is towards the direction of the first receiving portion, the second surface is in an exposed state, causing the turnable module recessed portion 35 to be in an exposed state.

When the turnable module 30 is disposed in the second receiving portion, the connection therebetween is completely identical to the connection between the turnable module 30 and the first receiving portion, which is thus not detailed here.

Figure 6:
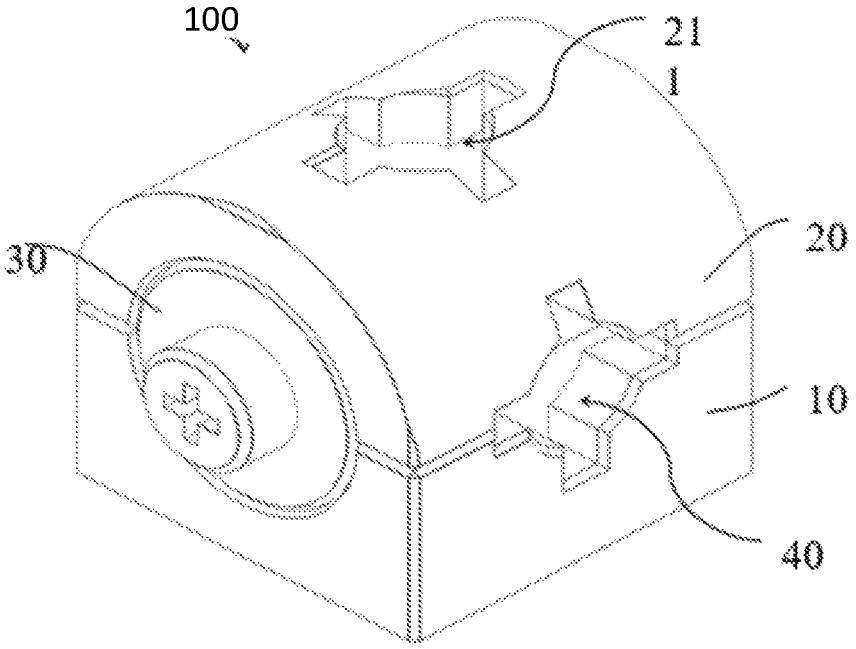
FIG. 6 shows an assembled structural schematic diagram of another embodiment of a building block provided by the present disclosure.
Figure 7:
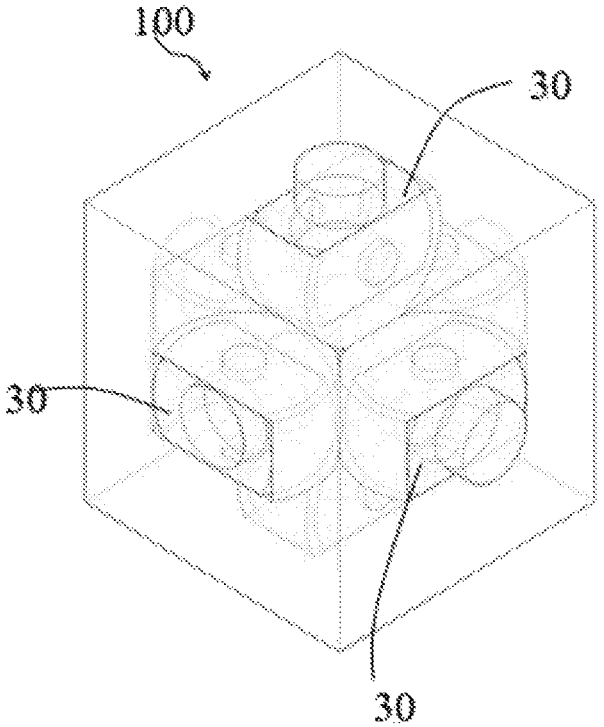
FIG. 7 shows an assembled structural schematic diagram and hidden detail of a further embodiment of a building block provided by the present disclosure.

Please refer to FIGS. 6 and 7, in other embodiments, the upper housing 20 and the lower housing 10 are further fitted to be capable of receiving other number of turnable modules 30, e.g., three, four or six turnable modules 30, etc. The specific number of the turnable modules 30 that may be received by the structure formed by fitting the upper housing 20 and the lower housing 10 may be changed according to actual needs, which is not limited herein.

The present disclosure further provides a building set 200, the building set 200 comprising a plurality of building blocks 100, the plurality of building blocks 100 being mutually assembled and spliced to form the building set 200. The building set 200 formed by assembling a plurality of building blocks 100 may have a plurality of shapes, e.g., cuboid, cubic, or other irregular patterns.

Figure 8:
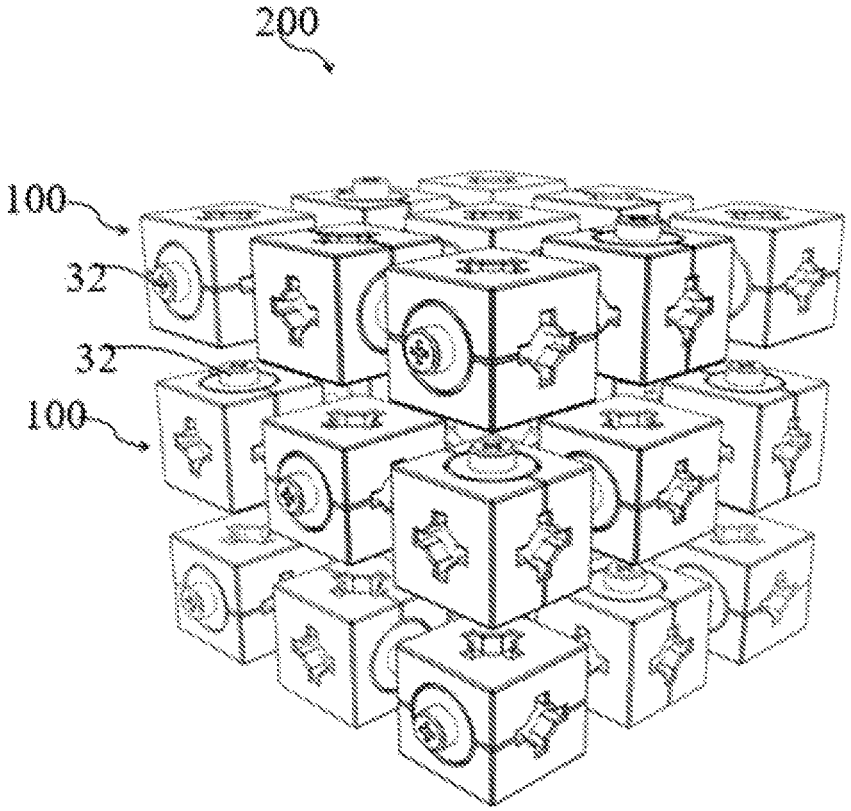
FIG. 8 shows a pre-assembled structural schematic diagram of a building set provided by the present disclosure.
Figure 9:
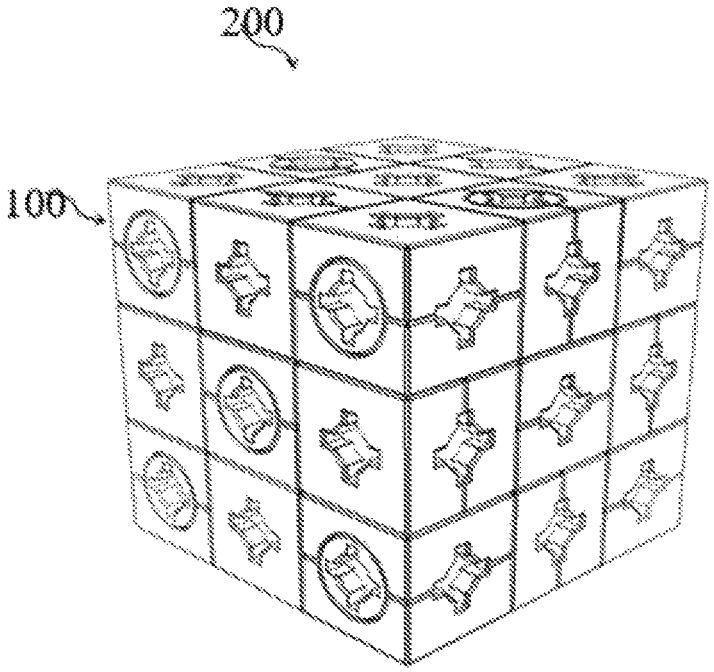
FIG. 9 shows an assembled structural schematic diagram of the building set shown in FIG. 8.

Please refer to FIG. 8 and FIG. 9, which show a pre-assembled structural schematic diagram of a building set provided by the present disclosure. In this embodiment, the building set 200 generally has a cubic structure. Hereinafter, an assembling process of the building set 200 will be described in detail.

In this embodiment, the building set 200 is an integral piece formed by interconnection between a plurality of building blocks 100. Specifically, the turnable module connection portion 32 of each building block 100 is selectively connected to one of the bottom portion connection portion 111, the top portion connection portion 211, or the side surface limiting portion of an adjacent building block 100, thereby implementing connection of two building blocks 100. Specifically, the turnable module connection portion 32 is snap-fitted to the bottom portion connection portion 111, the top portion connection portion 211, or the side surface limiting portion of the adjacent building block 100; and the length of the turnable module connection portion 32 is fitted to the depth of the bottom portion connection portion 111, the top portion connection portion 211, or the side surface limiting portion of the adjacent building block 100; namely, the length of the turnable module connection portion 32 is smaller than or equal to the depth of the bottom portion connection portion 111, the top portion connection portion 211, or the side surface limiting portion of the adjacent building block 100.

It is seen from the foregoing that extending directions of the two turnable module connection portions 32 of each building block 100 are on the same straight line. Extending directions of the two turnable module connection portions 32 of the two connected adjacent building blocks 100 are perpendicular to each other. For example, when a plurality of building blocks 100 are assembled into a cuboid structure, the surfaces of the cuboid structure will be formed by the turnable module connection portions 32 with a projected shape, the side surface connection portions 40, the bottom portion connection portions 111, and the top portion connection portions 211. The turnable module connection portion 32 may selectively cause the first surface 311 or the second surface 312 to be disposed at a surface of the building set 200: when the first surface 311 is disposed at the surface of the building set 200, the turnable module connection portion 32 projects from the first surface, such that the turnable module connection portion 32 may be connected with another building block 100; when the second surface 312 is disposed at the surface of the building set 200, the building set 200 is a quasi-planar structure. In other words, a building block 100 of the building set 200 may selectively cause the first surface or the second surface of the turnable module 30 to form a surface of the building set 200, such that the building set 200 may form a cuboid or cubic structure without projections on the surface, and in this way, the side surfaces of each building set 200 are all of a planar structure. It may be understood that the building set 200 may alternatively be assembled into other shapes, which are not limited herein.

The building block 100 provided by the present disclosure has advantages such as a simple structure and a low cost. Besides, the outer surfaces of the building set 200 assembled by building blocks 100 may have a planar structure. In this way, the present disclosure may be applied to assemble various kinds of cuboid structures, e.g., furniture such as a sliding drawer, a desk/chair with a lifting groove; alternatively, the present disclosure may be applied to assemble a model of a building, where it may not only facilitate the assembling work, but also may reduce the costs for research, development, and modeling; meanwhile, during the process of assembling building blocks, it may trigger the creativity of people and sooth their pressures in work and life.

What have been described above are only embodiments of the present disclosure, not for limiting the patent scope of the present disclosure. Any equivalent structure or equivalent flow change made based on the contents in the specification of the present disclosure, or a direct or indirect application to other related technical fields, should be included in the protection scope of the present disclosure.

What is claimed is:

1. A building set, comprising:

a plurality of building blocks configured to be interconnected to form an integral piece, wherein at least two of the plurality of building blocks each comprise:

a body structure enclosing a receiving space with an opening on a first side wall and comprising a connection portion on at least a second side wall of the body structure, and a turnable module configured to be at least partially disposed within the receiving space, the turnable module further comprising a turnable module body, a turnable module connection portion, a turnable module recessed portion, a first limiting portion, and a second limiting portion, wherein the turnable module body is a partial structure of a sphere, further comprising a first surface, a second surface parallel to the first surface, and a side surface connecting the first surface and the second surface, wherein the turnable module connection portion and the turnable module recessed portion are respectively disposed on one of the first surface and the second surface, wherein the turnable module connection portion is disposed outside the first side wall in a first orientation of the turnable module, and the first surface of the turnable module body is co-planar with a non-opening portion of the first side wall, wherein the turnable module recessed portion is exposed in a second orientation of the turnable module, and the second surface of the turnable module body is co-planar with the non-opening portion of the first side wall, wherein the turnable module is rotatable about the first limiting portion, and the second limiting portion is fitted with the first limiting portion to limit the turnable module at the first orientation or the second orientation, and wherein, to form the integral piece, two of the plurality of building blocks are configured to be detachably connected through a connection between, on one side, the turnable module connection portion of one of the two building blocks and, on another side, either the connection portion or the turnable module recessed portion of the other of the two building blocks.

2. The building set according to claim 1, wherein the first limiting portion is disposed in a middle portion of the turnable module body, and wherein the first limiting portion is a projected structure having a length and a diameter fitted to a depth and a diameter of a limiting portion of the receiving space.

3. The building set according to claim 2, wherein a first diameter of a first circular cross-section in the middle portion is larger than a second diameter of a second circular cross-section in an edge of the turnable module body.

4. The building set according to claim 2, wherein the second limiting portion is disposed in the middle portion of the turnable module body, wherein the second limiting portion is a projected structure having a length and a diameter fitted to a depth and a diameter of a side surface limiting portion of the receiving space, and wherein the diameter of the side surface limiting portion of the receiving space is smaller than that of the limiting portion in the receiving space.

5. The building set according to claim 4, wherein the projected structure of the second limiting portion has an extending direction perpendicular to an extending direction of the projected structure of the first limiting portion.

6. The building set according to claim 4, wherein the body structure is formed by fitting a lower housing and an upper housing, wherein the lower housing comprises a lower housing receiving portion and the upper housing comprises an upper housing receiving portion, and wherein the lower housing receiving portion and the upper housing receiving portion are each fitted to the turnable module and together form the receiving space.

7. The building set according to claim 6, wherein at least one of the lower housing receiving portion and the upper housing receiving portion comprises the first limiting portion of the receiving space.

8. The building set according to claim 6, wherein the lower housing receiving portion comprises a first half of the side surface limiting portion of the receiving space, wherein the upper housing receiving portion comprises a second half of the side surface limiting portion of the receiving space, and wherein the first half and the second half together form the side surface limiting portion of the receiving space when the lower housing and the upper housing are fitted to form the body structure.

9. The building set according to claim 6, wherein the lower housing comprises a bottom portion connection portion and a first half of a side surface connection portion, wherein the upper housing comprises a top portion connection portion and a second half of the side surface connection portion, wherein the first half and the second half together form the side surface connection portion when the lower housing and the upper housing are fitted to form the body structure, and wherein the connection portion on at least one surface of the body structure comprises at least one of the bottom portion connection portion, the top portion connection portion, or the side surface connection portion.

10. The building set according to claim 1, wherein the turnable module further comprises a through-hole through the turnable module body, and wherein the turnable module connection portion is partially received in the through-hole and partially extends out of the first surface.

11. The building set according to claim 1, wherein the body structure of at least one of the plurality of building blocks each encloses two identical receiving spaces for receiving and limiting two identical turnable modules on two opposite sides of the body structure.

* * * * *